United States Patent [19]

Saunders et al.

[11] 4,306,476

[45] Dec. 22, 1981

[54] HOLE PUNCH FOR A CUTTING DIE

[75] Inventors: Philip G. Saunders; Jack R. Simpson, both of Toledo, Ohio

[73] Assignee: Container Graphics Corporation, Toledo, Ohio

[21] Appl. No.: 110,781

[22] Filed: Jan. 9, 1980

[51] Int. Cl.[3] ..... B21D 45/04

[52] U.S. Cl. ..... 83/117; 83/128; 83/139; 493/342; 493/472

[58] Field of Search ..... 83/117, 138, 139, 116, 83/128, 123, 653; 76/107 C; 493/82, 83, 342, 373, 472

[56] References Cited

U.S. PATENT DOCUMENTS

| | | | |
|---|---|---|---|
| 2,374,436 | 4/1945 | Kennedy et al. | 83/139 |
| 2,519,159 | 8/1950 | Talbot | 83/117 |
| 2,522,154 | 9/1950 | Asmussen | 83/117 |
| 3,762,258 | 10/1973 | Bender | 83/139 X |

*Primary Examiner*—J. M. Meister

*Attorney, Agent, or Firm*—Allen D. Gutchess, Jr.

[57] ABSTRACT

A punch for a cutting die is provided for forming holes in corrugated board or the like. The hole punch includes a tubular metal member of circular transverse cross section having one end substantially flush with the back surface of a die plate in which it is mounted and the other end extending beyond the front surface of the die plate and terminating in a circular cutting edge. A body of resilient material, such as natural gum rubber or latex, is located within the cylindrical member and has one end terminating near the back end of the tubular member and another end terminating near the cutting edge of the tubular member. The purpose of the body is to eject and strip the scrap of corrugated board from the punch and from the rest of the blank being formed by the cutting die. The resilient body has a central, cylindrical passage extending completely therethrough, in a preferred form. This central passage enables the resilient material to be deformed inwardly when engaging a corrugated board being cut by the circular cutting edge, which provides a much longer life for the body of resilient material.

4 Claims, 5 Drawing Figures

HOLE PUNCH FOR A CUTTING DIE

This invention relates to a hole punch for a cutting die for producing holes in corrugated board or the like.

Cutting dies for shaping and forming sheet material, usually corrugated board, can be either flat or rotary. However, rotary dies are being increasingly used because of the higher production rates possible therewith. With the rotary cutting die equipment, a pair of cylinders are mounted in a frame with a gap of predetermined thickness therebetween. One of the cylinders carries a die plate mounted thereon with the appropriate cutting rules and punches. The other cylinder has a yieldable surface, usually a layer of plastic material, which supports the corrugated board when fed between the cylinders as they are rotated in opposite directions.

A cutting die for this operation includes a die plate on which is laid out the appropriate shape of the carton blank or the like to be produced. Saw cuts and holes are then made in the die plate, which is usually of plywood, to provide proper slots and openings for the cutting rules and hole punches.

The hole punch according to the invention includes a tubular member of circular transverse cross section usually held by a friction fit in a hole extending through the die plate. The back end of the tubular member preferably terminates at the back surface of the die plate so that it may be backed up by a die cylinder on which the plate is mounted. The front end of the tubular member extends beyond the front surface of the die plate and terminates in a circular cutting edge. The cutting edge is spaced from the front surface of the die plate by more than the thickness of the corrugated board in which the hole is to be formed. A resilient ejection body, preferably of natural gum rubber or latex tubing, is located in the tubular member and preferably has a back end terminating near the back end of the tubular member and a front end terminating near the cutting edge of the tubular member. As the hole is being formed in the corrugated board, the resilient body is deformed, and after the hole is formed, the resilient body returns to its original shape and strips and ejects the scrap of the corrugated board where the hole now exists. The front end of the resilient body can extend slightly beyond or slightly short of the plane of the cutting edge. Particularly with smaller punches, the resilient body preferably extends beyond the cutting edge to provide a more effective stripping and ejecting operation for the scrap.

The resilient body has a central void at least at the end adjacent the cutting edge and preferably the void is in the form of a cylindrical bore or passage extending completely through the body. The void provides a space into which the end portion of the resilient body adjacent the cutting edge can yield and deform as the hole is being formed in the corrugated board and the resilient body is being forced inwardly. It has been found that the void in the resilient body enables the body to have a substantially longer life than if a solid resilient body were used in the tubular member. Further, with the void being in the form of a passage extending completely through the resilient body, the body can be reversed in the tubular member to present a fresh end at the corrugated board when the other end has become worn or loses its resiliency.

It is, therefore, a principal object of the invention to provide a hole punch for a cutting die having the features and advantages discussed above.

Many other objects and advantages of the invention will be apparent from the following detailed description of a preferred embodiment thereof, reference being made to the accompanying drawings, in which.

Figure 1:
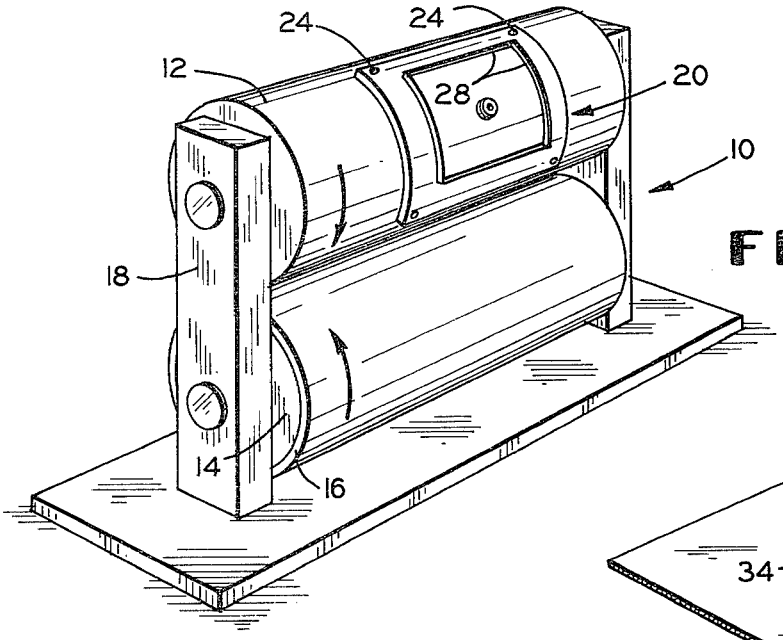
FIG. 1 is a somewhat schematic view in perspective of rotary cutting die equipment embodying the invention.
Figure 2:
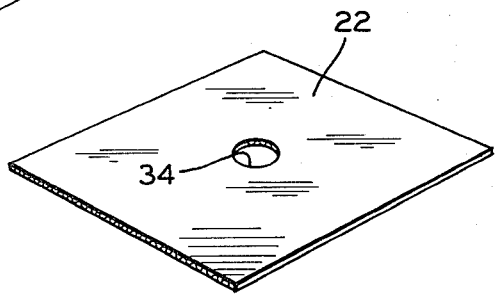
FIG. 2 is a view in perspective of a corrugated board blank formed by a rotary cutting die of FIG. 1.

Referring to the drawings, and particularly to FIG. 1, rotary cutting die equipment is indicated at 10 and includes an upper die cylinder or roll 12 and a lower backup cylinder or roll 14. A yieldable layer 16 of polyurethane plastic or other suitable material is located around the backup cylinder 14. The cylinders are rotatably mounted in a frame or stand 18 and are rotated in the direction of the arrows by suitable means (not shown). Corrugated board or similar sheet material is fed between the cylinders 12 and 14 where it is engaged by a rotary cutting die 20 and is shaped into a blank 22 (FIG. 2) from which cartons or other products can be formed. The cutting die 20 is fastened to the cylinder by any suitable means, such as fasteners 24.

In making a cutting die 20, a die plate 26 of appropriate size and thickness is used. This plate usually is made of high quality, five-eighths inch plywood formed in an arcuate shape with a radius equal to the radius of the cylinder 12. The shape of the blank 22 is then laid out on the die plate 26 and slots are formed in the die plate at appropriate positions to receive cutting rules 28 which, in this instance, form the peripheral shape of the blank 22. A hole 30 is also made in the die plate 26 to receive a hole punch 32 in accordance with the invention, which forms a hole or aperture 34 in the blank 22.

Figure 3:
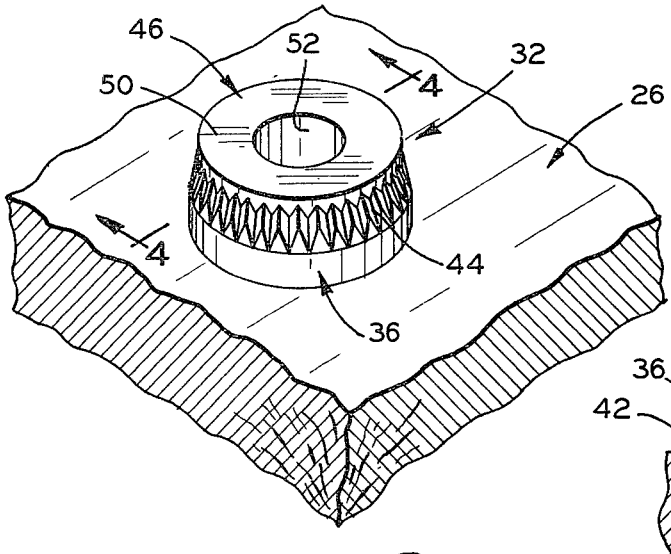
FIG. 3 is a fragmentary view in perspective of a cutting die plate and a hole punch in accordance with the invention.
Figure 4:
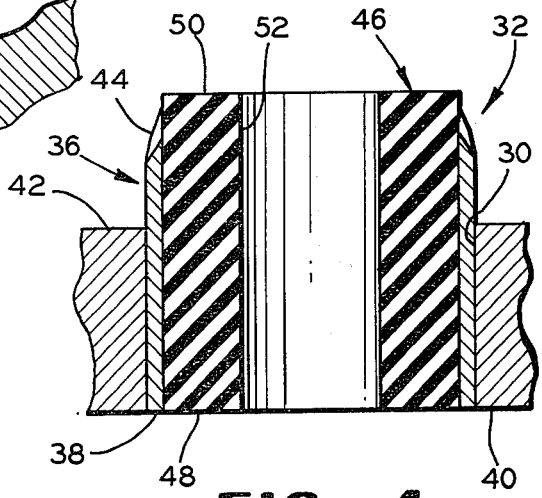
FIG. 4 is an enlarged view in cross section taken along the line 4—4 of FIG. 3.

The hole punch 32 is usually affixed in the die plate 26 and specifically in the hole 30 by a friction fit. The punch 32 includes a tubular metal member 36 of circular transverse cross section. A back end 38 of the tubular member preferably is flush with a back surface 40 of the die plate 26 so that the punch can be backed up by the cylinder 12 when the die plate is mounted thereon. The front end of the tubular member 36 extends beyond a front surface 42 of the die plate 26 and terminates in a circular cutting edge 44. The cutting edge 44 is preferably serrated, as shown in FIG. 3, and is spaced from the front surface of the die plate 26 by a distance exceeding the thickness of the corrugated board.

A body 46 of resilient material is located within the tubular member 36. The body preferably is made of natural gum rubber or latex which is resilient, but is incompressible. The body 46 preferably has a back end 48 terminating near the back end 38 of the tubular member 36 and a front end 50 terminating near the plane of the cutting edge 44. The end 50 of the body can extend slightly beyond or stop slightly short of the cutting edge 44. However, particularly with smaller punches, the stripping and ejecting operation is more effective with the end 50 extending slightly beyond the cutting edge 44.

In accordance with the invention, the resilient body 46 has a central void 52 at least in an end portion at the front end 50. Preferably, however, the void 52 is in the form of a passage or bore which extends completely through the body 46 from the end 50 to the end 48. With this design, the resilient body 46 can be made of tubular material. Further, when the front end 50 of the tubular member becomes worn or loses its resiliency, the body 46, which can have a friction fit in the tubular member 36, can be removed and reversed to present the opposite end toward the corrugated board. The void 52 preferably has a circular cross section similar to the outer cross sectional shape of the body 46. The diameter of the void 52 preferably is from one-fourth to three-fourths of the outer diameter of the body 46.

Figure 5:
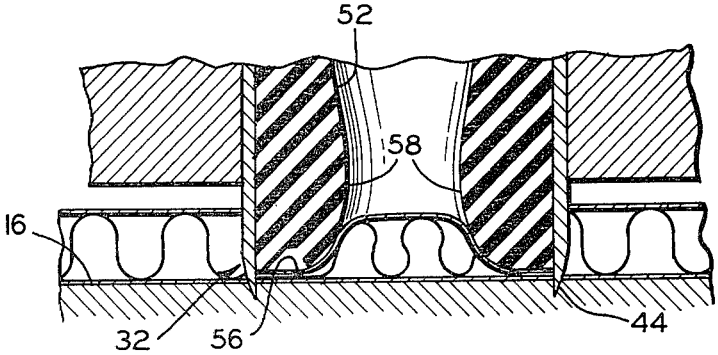
FIG. 5 is a view similar to FIG. 4 of the hole punch forming a hole in corrugated board.

In the operation of the hole punch 32, as the cylinder 12 rotates with corrugated board 54 fed therebetween, the cutting edge 44 penetrates the entire thickness of the corrugated board and preferably projects slightly into the yieldable layer 16 on the backup cylinder 14, as shown in FIG. 5. As the tubular member 36 cuts through the corrugated board 54, the front end 50 of the resilient body 46 engages the surface of the corrugated board and compresses it in an annular area 56. At this time, the resilient body 46 is pushed inwardly and the displaced material moves inwardly to form an annular bulge 58 extending into the void 52. Without the void or passage 52, the material of the resilient body 46 has no space to be displaced and the life of the body is considerably shortened. The life of the resilient body 46 with the void 52 is at least several times that of a solid resilient body. As the punch 32 separates from the corrugated board 54, the resilient material of the body 46 resumes its original shape, causing the scrap or corrugated board to be stripped and ejected from the tubular member 36 of the punch 32. Because the material at the annular area 56 is crushed to such a thin state, substantially only the thickness of three papers, it is considerably easier to eject from the tubular member 36 than heretofore when most of the crushing took place at the center of the scrap piece.

Various modifications of the above-described embodiment of the invention will be apparent to those skilled in the art, and it is to be understood that such modifications can be made without departing from the scope of the invention, if they are within the spirit and the tenor of the accompanying claims.

We claim:

1. A cutting die for forming a hole in corrugated board or the like, said cutting die including a die plate having a front surface and a back surface, an open-ended tubular member held by said die plate and having one open end terminating at the back surface of said die plate, said member having another open end extending beyond the front surface of said die plate and terminating in a cutting edge, and a body of resilient material within said tubular member and having an outer diameter about equal to the inner diameter of said tubular member, said resilient body having a central void in the form of a passage extending completely through said resilient body from one end to the other end, said resilient body having one end terminating near the cutting edge of said tubular member, said resilient body having the other end terminating at said one open end of said tubular member, with said back surface of said die plate, said one end of said tubular member, and said other end of said resilient body being substantially in a common plane.

2. A cutting die according to claim 1 characterized by said body of resilient material being of incompressible gum rubber.

3. A cutting die for forming a hole in corrugated board or the like, said cutting die including a die plate having a front surface and a back surface, an open-ended tubular member held by said die plate and having one open end terminating at the back surface of said die plate, said member having another open end extending beyond the front surface of said die plate and terminating in a cutting edge, and a tubular body of resilient material within said tubular member and having an outer diameter about equal to the inner diameter of said tubular member and held therein by a friction fit, said resilient body having a central void in the form of a passage extending completely through said resilient body from one end to the other end, said resilient body having one end terminating near the cutting edge of said tubular member, said resilient body having the other end terminating near said one open end of said tubular member, said resilient body being reversible from end-to-end in said tubular member to place said other end of said resilient body near said cutting edge of said tubular member.

4. A cutting die according to claim 3 wherein said passage is of circular cross-sectional shape.

* * * * *